US012253083B2

(12) United States Patent
Sa et al.

(10) Patent No.: US 12,253,083 B2
(45) Date of Patent: Mar. 18, 2025

(54) ROTARY COMPRESSOR

(71) Applicant: LG ELECTRONICS INC., Seoul (KR)

(72) Inventors: Bumdong Sa, Seoul (KR); Seseok Seol, Seoul (KR); Seokhwan Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 88 days.

(21) Appl. No.: 17/926,210

(22) PCT Filed: Apr. 15, 2021

(86) PCT No.: PCT/KR2021/004733
§ 371 (c)(1),
(2) Date: Nov. 18, 2022

(87) PCT Pub. No.: WO2021/235703
PCT Pub. Date: Nov. 25, 2021

(65) Prior Publication Data

US 2023/0184250 A1 Jun. 15, 2023

(30) Foreign Application Priority Data

May 22, 2020 (KR) ..... 10-2020-0061623

(51) Int. Cl.
*F04C 18/344* (2006.01)

(52) U.S. Cl.
CPC ..... *F04C 18/344* (2013.01); *F04C 2210/12* (2013.01); *F04C 2240/20* (2013.01); *F04C 2240/50* (2013.01)

(58) Field of Classification Search
CPC ..... F01C 21/0836; F04C 18/344; F04C 2210/12; F04C 2240/20; F04C 2240/50
See application file for complete search history.

(56) References Cited

U.S. PATENT DOCUMENTS 2,264,616 A * 12/1941 Buckbee ..... F04C 29/02 418/256
3,904,327 A * 9/1975 Edwards ..... F01C 1/3446 418/8

(Continued)

FOREIGN PATENT DOCUMENTS

CN 1548747 11/2004
JP 10-506973 7/1998

(Continued)

OTHER PUBLICATIONS

International Search Report dated Jul. 19, 2021 issued in Application No. PCT/KR2021/004733.

*Primary Examiner* — Anthony Ayala Delgado
(74) *Attorney, Agent, or Firm* — KED & ASSOCIATES

(57) ABSTRACT

A rotary compressor is provided that may include a cylinder; a chamber eccentrically formed in the cylinder and accommodating a predetermined working fluid; a rotor rotatably received in the chamber and arranged so as to be concentric to the cylinder; first and second bearings disposed on upper and lower portions, respectively, of the cylinder so as to close the chamber, and which support a drive shaft of the rotor; a plurality of vanes movably installed on the rotor in a radial direction thereof, and protruding from the rotor up to an inner circumferential surface of the cylinder so as to divide the chamber into a plurality of compression spaces; first and second guide grooves which, in order to accommodate a portion of the vanes, are formed on respective surfaces, facing the chamber, of the first and second bearings so as to be concentric to the chamber, and guide the plurality of vanes while the rotor is rotating so that the plurality of vanes continuously protrude up to the inner circumferential surface of the cylinder; and an auxiliary bearing which is (Continued)

provided in at least one of the first guide groove or the second guide groove and rotating with the plurality of vanes.

19 Claims, 12 Drawing Sheets

(56) References Cited

U.S. PATENT DOCUMENTS

| | | | | |
|---|---|---|---|---|
| 4,212,603 | A * | 7/1980 | Smolinski | F01C 21/0836 418/256 |
| 4,955,985 | A * | 9/1990 | Sakamaki | F01C 21/0809 418/265 |
| 4,997,353 | A | 3/1991 | Sakamaki et al. | |
| 2014/0271303 | A1* | 9/2014 | Sekiya | F04C 18/352 418/55.1 |

FOREIGN PATENT DOCUMENTS

| | | |
|---|---|---|
| KR | 10-1990-0003682 | 5/1990 |
| KR | 10-2013-0031736 | 3/2013 |

* cited by examiner (a)

(b)

ROTARY COMPRESSOR

CROSS-REFERENCE TO RELATED PATENT APPLICATIONS

This application is a U.S. National Stage Application under 35 U.S.C. § 371 of PCT Application No. PCT/KR2021/004733, filed Apr. 15, 2021, which claims priority to Korean Patent Application No. 10-2020-0061623, filed May 22, 2020, whose entire disclosures are hereby incorporated by reference.

BACKGROUND

1. Field

A rotary compressor, and more particularly, a rotary compressor including a rotating vane is disclosed herein.

2. Background

In general, a compressor is a machine that increases a pressure of working fluid by receiving power from a power generating device, such as an electric motor or a turbine, and applies compression work to a working fluid, such as air or refrigerant. Such compressors are widely used in air conditioners and refrigerators, that is, from small devices, such as home appliances, to large devices, such as oil refineries and chemical plants.

Such a compressor may be classified into a positive displacement compressor and a dynamic compressor or a turbo compressor according to a compression method. Among them, a positive displacement compressor widely used in industry has a compression method for increasing a pressure through a decrease in volume. The positive displacement compressor may be classified into a reciprocating compressor and a rotary compressor according to a compression mechanism.

The reciprocating compressor compresses a working fluid by a piston that reciprocates in a straight line inside of a cylinder, and advantageously produces high compression efficiency with relatively simple mechanical elements. However, the reciprocating compressor has a limitation in rotation speed due to inertia of the piston, and disadvantageously generates significant vibration due to inertia force. In contrast, the rotary compressor compresses a working fluid by a rotor rotating inside of the cylinder, and is capable of producing high compression efficiency at a lower speed than the reciprocating compressor. Therefore, the rotary compressor advantageously generates less vibration and noise, and has recently been used more widely than the reciprocating compressor, especially in home appliances. Such a rotary compressor is arranged in the cylinder and may be subdivided into a fixed vane-type compressor and a rotating vane-type compressor according to an operation method of the vane for dividing an inner space of the cylinder into variable subspaces that is, compression spaces. The fixed vane compressor includes a rotor that rotates eccentrically along an inner circumferential surface of the cylinder, and a vane that is arranged in a stationary state between the cylinder and the rotor. In addition, the rotating vane-type compressor includes a rotor rotating in a cylinder and a vane rotating together with the rotor between an inner peripheral surface of the cylinder and the rotor.

In such a rotating vane-type compressor, the vane may define a variable compression space in the cylinder. Therefore, if the vane does not have an accurate orientation at an accurate position, a working fluid may leak between the cylinder and the vane, accurately between the inner circumferential surface of the cylinder and an end of the vane facing the same. In particular, as the vane rotates at a high speed with the rotor, accurate placement and orientation of the vane may be even more important for the reliability and stability of the compressor. In addition, although the vane is under a harsh operating environment, such as continuous high-speed rotation, the vane does not have a structure and shape having high strength and rigidity. Therefore, in order to ensure the reliability and stability of the compressor, it is also necessary to consider the structural stability and reliability of the vane.

In this regard, Japanese Patent No. JP5660919 discloses a rotary compressor in which a vane is accurately positioned with respect to a rotor and a cylinder. However, the rotary compressor of Japanese Patent Registration JP5660919 uses many members, such as a vane guide and a vane bush, to guide the vane, and thus, causes an increase in production costs and a decrease in productivity. In addition, in Japanese Patent Registration JP5660919, the structural stability of the vane itself is not specifically considered.

Embodiments disclosed herein have been devised to solve the above-mentioned problems, and provide a rotary compressor for accurately orienting a vane while having a simple structure. Embodiments disclosed herein also provide a rotary compressor comprising a vane having structural stability and reliability.

Embodiments disclosed herein provide a guide structure of a vane having a simple structure in order to solve the above-mentioned problems. The guide mechanism is implemented through a simple mechanical structure, such as slots and grooves, and thus, may be formed by simple mechanical processing and may not increase the number of parts or components. In addition, the guide mechanism may accurately orient the vanes without failure or damage due to a simple structure thereof.

Embodiments disclosed herein may also include an additional bearing structure that supports rotational motion of the vane. The bearing structure may prevent wear and damage of the vane while enabling the vane to rotate.

Embodiments disclosed herein provide a rotary compressor that may include a cylinder, a chamber eccentrically formed in the cylinder and accommodating a predetermined working fluid, a rotor rotatably accommodated within the chamber and disposed concentrically to the cylinder, first and second bearings that are disposed above and below the cylinder to seal the chamber, respectively and support a drive shaft of the rotor, a plurality of vanes installed in the rotor to be moved in a radial direction of the rotor and protruding to an inner circumferential surface of the cylinder from the rotor to divide the chamber into a plurality of compression spaces, first and second guide grooves formed concentrically to the chamber on surfaces of the first and second bearings, facing the chamber of the first and second bearings, to accommodate a portion of the vanes and continuously guiding the vanes to protrude to the inner circumferential surface of the cylinder while the rotor rotates, and an auxiliary bearing provided in any one of the first and second guide grooves and rotating with the vanes. The auxiliary bearing may include an outer ring fixed in any one of the first and second guide grooves, and an inner ring in contact with a portion of the vanes and rotating relative to the outer ring with a portion of the vanes. The auxiliary bearing may further include a rolling member disposed between the outer ring and the inner ring.

The auxiliary bearing may further include a cover that isolates the bearing from the chamber. The cover may entirely cover a surface of the auxiliary bearing, facing the chamber. The auxiliary bearing may be accommodated not to protrude into any one of the first and second grooves.

The auxiliary bearing may be disposed to overlap the rotor. A width of an overlap region of the auxiliary bearing and the rotor may be set to at least 1.5 mm.

The vane may include a body including a first end portion elongated in a radial direction of the rotor and disposed in the rotor, and a second end portion adjacent to an inner circumferential surface of the cylinder, and a pin that extends from the first end portion of the body and inserted into any one of the first and second guide grooves to be in contact with the auxiliary bearing. The pin may be in contact with an inner ring of the auxiliary bearing, and furthermore, may be fixed to the inner ring of the auxiliary bearing. The pin may be integrally formed with the body or may be detachably installed on the body.

A lubricating member having a low friction coefficient may be disposed in the first and second grooves.

A compressor according to embodiments disclosed herein may include only a slot of a rotor and a guide groove of a bearing as a guide mechanism of a vane. The guide mechanism may be formed by simple mechanical processing and may not increase the number of parts or components. Therefore, the guide mechanism may have a simple structure, and may be easily provided in the compressor by a simple process. The guide mechanism may accurately orient and move the vane toward the rotor and the center of the cylinder during an operation of the compressor. For this reason, the guide mechanism may achieve reliability and stability of operation while increasing productivity of the compressor.

In addition, the compressor according to embodiments disclosed herein may further include an additional auxiliary bearing that rotatably supports the vane. The auxiliary bearing may enable the vanes to rotate smoothly while in contact with the bearing which is stationary instead of the vanes to support the vanes. Therefore, the auxiliary bearing may significantly reduce the relative speed of the vanes with respect to the bearing which is stationary, and thus, wear and breakage due to friction of the vanes may also be significantly reduced. For this reason, the auxiliary bearing may largely increase the structural stability and reliability of the vanes, and accordingly, the stability and reliability of the compressor itself may also be increased.

DETAILED DESCRIPTION

Figure 1:
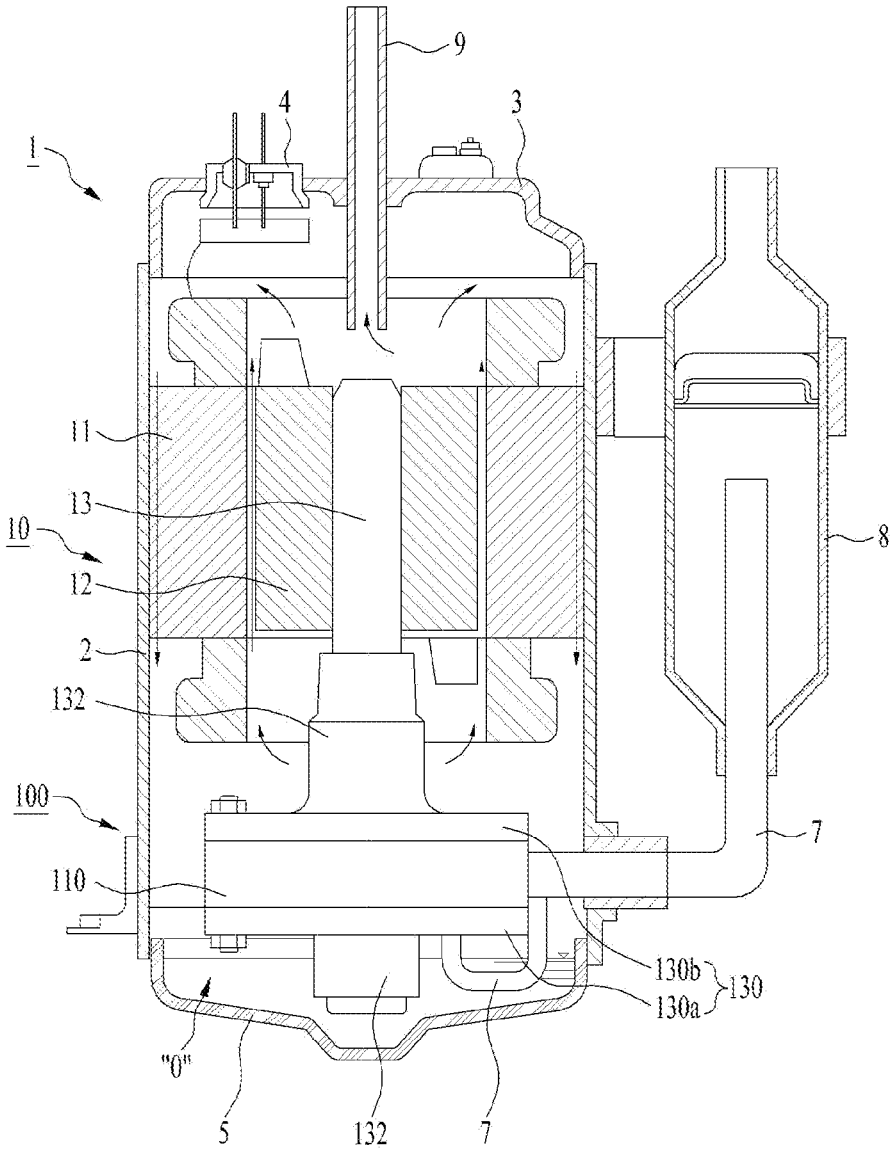
FIG. 1 is a partial cross-sectional view of a rotary compressor according to an embodiment.

Examples of a rotary compressor according to embodiments will be described below with reference to the accompanying drawings.

In the description of these examples, the same reference numerals in the drawings denote like elements, and a repeated explanation thereof will not be given. The suffixes "module" and "unit" of elements herein are used for convenience of description and thus may be used interchangeably, and do not have any distinguishable meanings or functions. In the following description of the at least one embodiment, a detailed description of known functions and configurations incorporated herein will be omitted for the purpose of clarity and for brevity. The features of the present disclosure will be more clearly understood from the accompanying drawings and should not be understood to be limited by the accompanying drawings, and it is to be appreciated that all changes, equivalents, and substitutes that do not depart from the spirit and technical scope of the present disclosure are encompassed in the present disclosure.

It will be understood that, although the terms "first", "second", etc. may be used herein to describe various elements, these elements should not be limited by these terms. These terms are only used to distinguish one element from another element.

It will be understood that when an element is referred to as being "on", "connected to" or "coupled to" another element, it may be directly on, connected or coupled to the other element, or intervening elements may be present. In contrast, when an element is referred to as being "directly on," "directly connected to" or "directly coupled to" another element or layer, there are no intervening elements present.

Singular expressions in the present specification include the plural expressions unless clearly specified otherwise in context.

It will be further understood that the terms "comprises" or "comprising" when used in this specification specify the presence of stated features, numbers, steps, operations, elements, or components, but do not preclude the presence or addition of one or more other features, numbers, steps, operations, elements, components, or groups thereof. In addition, for the same reason, the present application also provides some features from combinations of related features, numbers, steps, operations, components, and parts described using the above-mentioned terms without departing from the intended technical purpose and effect of the disclosed application. It should also be understood that combinations in which numbers, steps, operations, components, parts, etc. are omitted are also included.

Examples described in the present application relate to a rotary compressor including a vane that rotates with a rotor. The principles and configuration of the examples described may be applied without substantial modification to any type of device having a moving vane without substantial modification.

First, an overall configuration of an example of a rotary compressor according to an embodiment will be described below with reference to the related drawings. In this regard, FIG. 1 is a partial cross-sectional view of a rotary compressor according to an embodiment.

Referring to FIG. 1, a rotary compressor 1 according to an embodiment may include a case 2, and a power part or portion 10 and a compression part or portion 100 that are disposed inside of the case 2. In FIG. 1, the power part 10 may be disposed at an upper portion of the compressor 1 and the compression part 100 may be disposed at a lower portion of the compressor 1, but the positions may be changed as necessary. An upper cap 3 and a lower cap 5 may be installed at upper and lower portions of the case 2, respectively, to define a sealed inner space. A suction pipe 7 may be installed at a side of the case 2, and a working fluid, such as a refrigerant or air may also be suctioned from outside of the compressor 1. In addition, an accumulator 8 may be connected to the suction pipe 7 to separate lubricants and other foreign substances from the working fluid. A discharge pipe 9 through which compressed working fluid is discharged may be installed at a center of the upper cap 3. Also, the lower cap 5 may be filled with a predetermined amount of lubricant 0 for lubrication and cooling of moving members or components.

The power part 10 may include any power device for supplying power required to the rotary compressor 1. Among these power devices, the power part 10 may include, for example, an electric motor that is compact and also generates power with high efficiency. The power part 10 may include a stator 11 fixed to the case 2, a rotor 12 rotatably supported inside of the stator 11, and a drive shaft 13 coupled to the rotor 12. The rotor 12 may be rotated electromagnetic force generated by the stator 11 and the rotor 12, and the drive shaft 13 may transfer a rotational force of the rotor 12 to the compression part 100. To supply external power to the stator 11, a terminal 4 may be installed in the upper cap 3.

The compression part 100 may compress a working fluid to have a predetermined pressure and discharge the compressed working fluid. For such compression of the working fluid, the compression part 100 may be connected to the suction pipe 7 to receive a working fluid to be compressed, as shown in FIG. 1. The compression part 100 may communicate with the discharge pipe 9 to discharge the compressed working fluid. That is, as shown in the drawing, the compressed working fluid may be discharged from the compression part 100 to the sealed inner space of the case 2, and then may be discharged to the outside of the case 2 through the discharge pipe 9. Like the suction pipe 7, the discharge pipe 9 may be directly connected to the compression part 100. The compression part 100 may be connected to the power part 10 by the drive shaft 13 to receive the rotational force required for compression. The compression part 100 may include parts or components that are moved at high speed by the power of the power part 10, and thus, may be firmly fixed in the case 2. The compression part 100 will be described below with reference to the related drawings.

Figure 2:
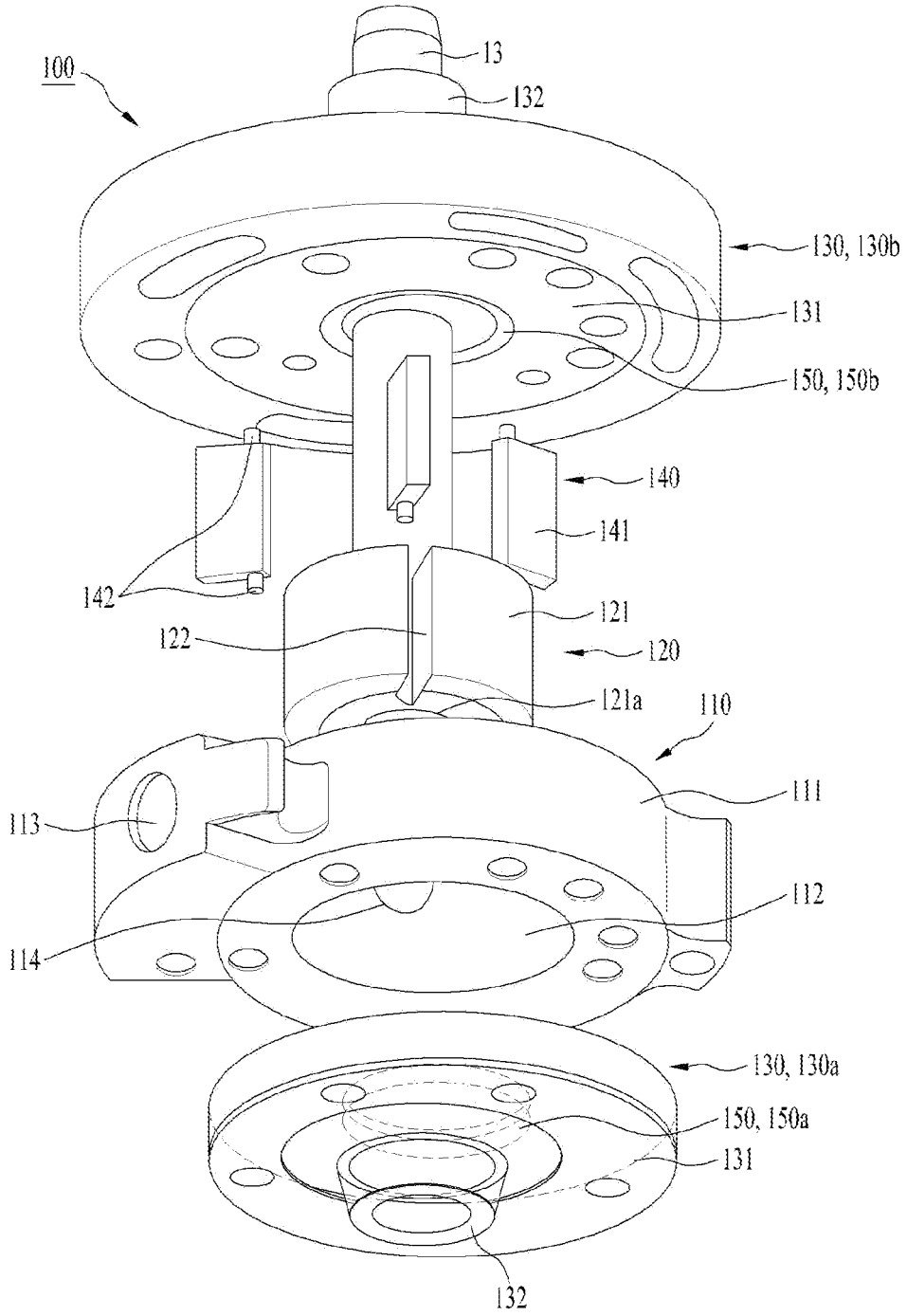
FIG. 2 is an exploded perspective view of a compression part of a rotary compressor according to an embodiment.
Figure 3:
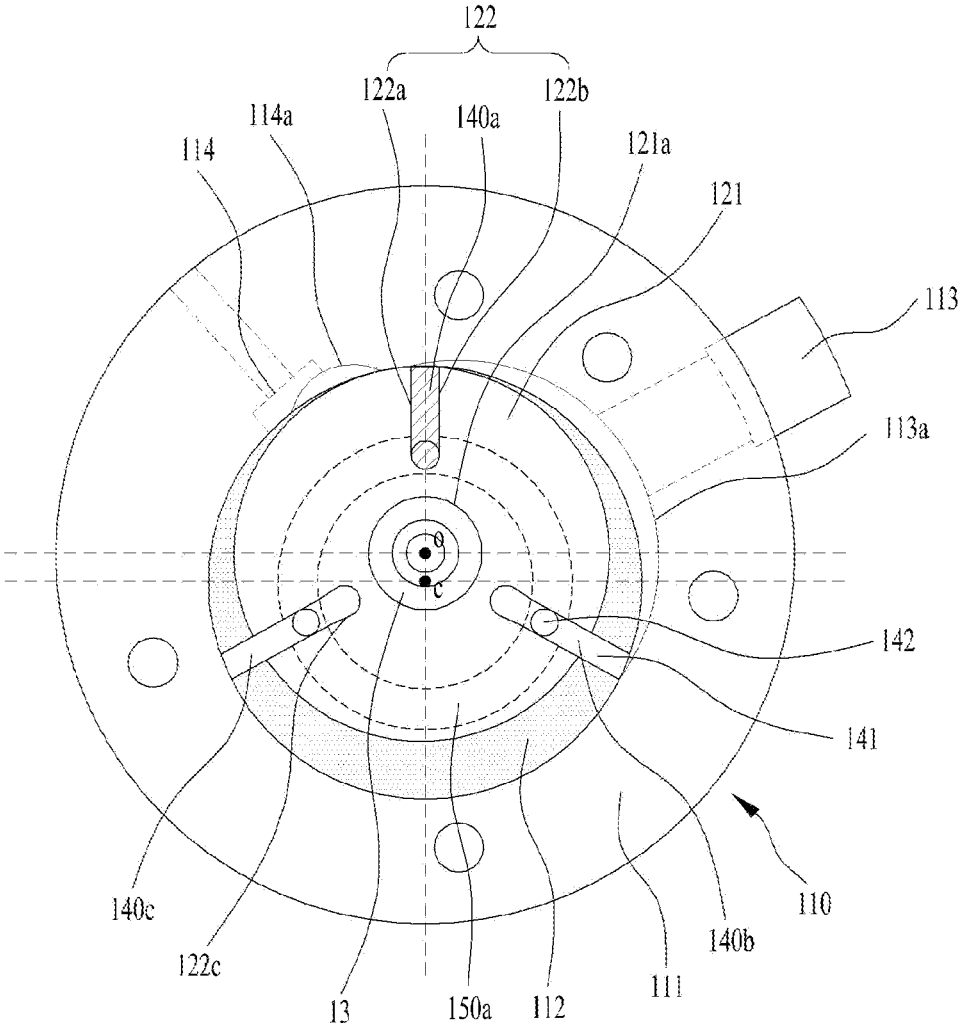
FIG. 3 is a plan view of a compression part from which an upper bearing is removed.
Figure 4:
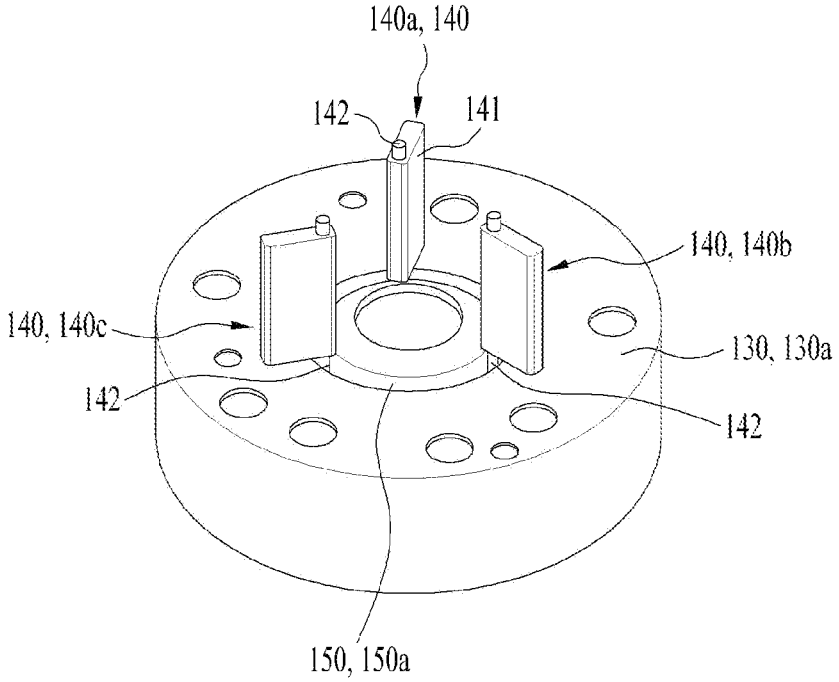
FIG. 4 is a perspective view of an assembly of a lower bearing and a vane.
Figure 5:
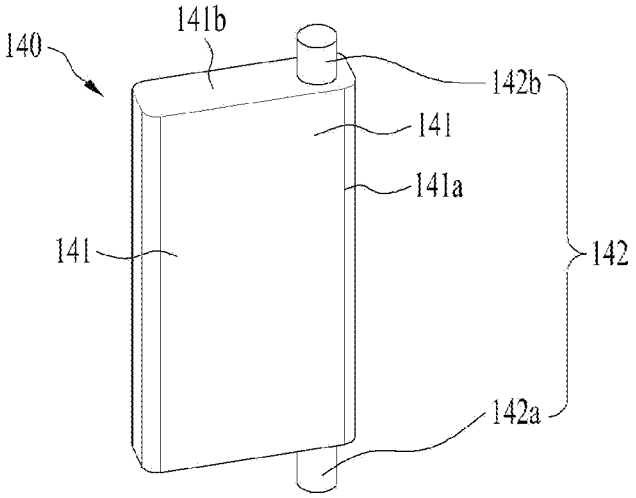
FIG. 5 is a perspective view of a vane.
Figure 6:
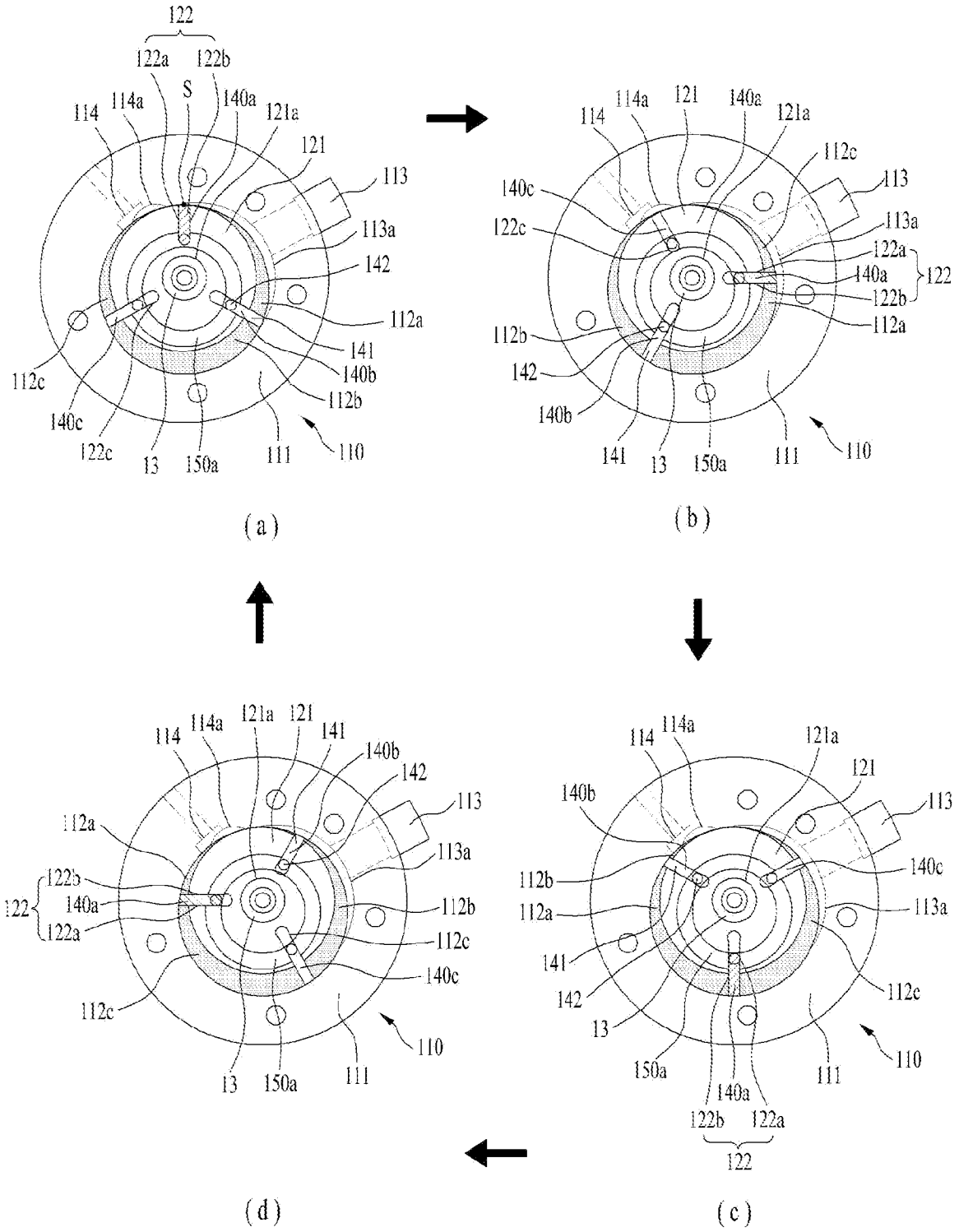
FIG. 6 is a plan view showing an operation of a rotary compressor step by step according to an embodiment.

FIG. 2 is an exploded perspective view of a compression part of a rotary compressor according to an embodiment. FIG. 3 is a plan view of a compression part from which an upper bearing is removed, and FIG. 4 is a perspective view of an assembly of a lower bearing and a vane. FIG. 5 is a perspective view of a vane. FIG. 6 is a plan view showing an operation of a rotary compressor step by step according to an embodiment. The plan view of FIG. 3 shows the assembly of the cylinder, rotor, lower bearing, and vane with the upper bearing removed to show the inside of the cylinder well, and FIG. 6 also includes plan views of the same assembly for the same purpose.

First, the compression part 100 may include a cylinder 110 disposed inside of the case 2. The cylinder 110 may have a body 111 having a ring shape with a substantially constant thickness, and may have a body having a different shape, if necessary. The cylinder 110 may include a chamber 112 that is formed inside of the body 111 and has a predetermined size. The chamber 112 may define a working space that receives a working fluid for compression. The cylinder 110 may include a suction port 113 and a discharge port 114 that are formed on the body 111 and communicate with the chamber 112. The suction port 113 may be connected to the suction pipe 7 to supply a working fluid into the chamber 112, and the discharge port 114 may communicate with the discharge pipe 9 for discharging the compressed working fluid. The suction port 113 and the discharge port 114 may be disposed on the body 111 while being spaced apart from each other at a predetermined angle and spacing for suction and discharge of the working fluid without interfering with each other. In addition, as shown in FIG. 3, the cylinder 110 may include the suction port 113 on an inner circumferential surface thereof (accurately, the inner circumferential surface of the body 111) defining the chamber 112 and recesses or dimples 113*a* and 114*a* formed around the discharge port 114. These recesses 113*a* and 114*a* may prevent vortex flow of the working fluid due to rapid suction and discharge of the working fluid, and thus, the working fluid may be smoothly suctioned and discharged. In addition, a size of the chamber 112 may be substantially expanded by the recesses 113*a* and 114*a*, and thus, a greater amount of working fluid may be smoothly suctioned and discharged. In the cylinder 110, the chamber 112 may be arranged eccentrically in a radial direction to the cylinder 110, as shown in FIG. 3. That is, a center C of the chamber 112 may be radially spaced apart from a center O of the cylinder 110 at a predetermined interval. This arrangement is for the cylinder 110 to define a variable compression space with the other members of the compression part 100, which will be described hereinafter.

The compression part 100 may also include a rotor 120 rotatably accommodated within the chamber 112 of the cylinder 110. The rotor 120 may have a body 121 with a circular cross-section, that is, a disk-shaped body 121, as shown in FIGS. 2 and 3. In addition, the rotor 120 may have a through hole 121*a* disposed in a center of the body 121 thereof, and the drive shaft 13 of the power part 10 may be press-fitted into the through hole 121*a*. Thus, the rotor 120 may rotate about a central axis thereof, that is, the drive shaft 13, by power provided by the power part 10 within the chamber 112 of the cylinder 110. In addition, the rotor 120 may be disposed concentrically with the cylinder 110, as shown in FIG. 3. Thus, the rotor 120 may also be disposed radially and eccentrically to the chamber 112 eccentrically to the cylinder 110. That is, the rotor 120 may share the same center O with the cylinder 110, and this center O may be radially spaced apart from the center C of the chamber 112 by a predetermined distance. The center O of the rotor 120 may be disposed on the central axis of the drive shaft 13, and thus, may be rotated within the chamber 112 by the drive shaft 13 without eccentricity. According to this arrangement, the rotor 120 may be disposed at a radial end of the chamber 112, as shown in FIG. 3, and accordingly, an outer periphery of the rotor 120 may be disposed adjacent to an outer periphery of the chamber 112, that is, an inner circumferential surface or an inner periphery of the cylinder the body 111. Accordingly, a space having a cross-section or volume varying in a circumferential direction of the cylinder 110 or the chamber 112 may be formed between the outer peripheries of the rotor 120 and the chamber 112 which are opposite to adjacent outer peripheries, and in practice, the space may be used as a compression space that accommodates and compresses a working fluid.

The compression part 100 may include a bearing 130 disposed on the cylinder 110 and closing the chamber 112 inside of the cylinder 110. The bearing 130 may include first and second bearings 130*a* and 130*b* disposed above and below, that is, on bottom and top surfaces of, the cylinder 110, accurately, above and below the body 111, respectively, to cover the chamber 112. In order to prevent a working fluid compressed with high pressure in the chamber 112 from leaking, the bearings 130: 130*a* and 130*b* may be firmly coupled to the body 111 of the cylinder 110 using a fastening member. In addition, the bearings 130: 130*a* and 130*b* may support the drive shaft 13 coupled with the rotor 120. The bearings 130: 130*a* and 130*b* may include sleeves 132 that surround the drive shaft 13, as shown in FIG. 2. The sleeve 132 of the first bearing 130*a* may support a portion of the drive shaft 13 below the rotor 120, and the sleeve 132 of the second bearing 130*b* may support a portion of the drive shaft 13 above the rotor 130. Thus, due to these sleeves 132, the rotor 120 may rotate stably at high speed within the cylinder 110.

The compression part 100 may include a plurality of vanes 140 provided in the rotor 120. For example, as shown in FIGS. 3 and 4, the compression part 100 may include first to third vanes 140*a*, 140*b*, and 140*c*, and if necessary, may include fewer or more vanes 140. The vanes 140: 140*a* to 140*c* may be spaced apart at equal intervals and angles, for example, at intervals of 120°, and may have a same radial length while extending radially from the rotor 120, as shown in the drawing. As shown in FIG. 3, the vanes 140 may be disposed within the chamber 112, accurately in a remaining space of the chamber 112 except for a space occupied by the rotor 120 that is, a space between an outer periphery of the rotor 120 eccentrically to the chamber 112 and an outer periphery of the chamber 112 (hereinafter, referred to as an "effective space" of the chamber 112), and the effective space may be divided into a plurality of compression spaces for compression of a working fluid. That is, the vanes 140 may divide the effective space while extending from the outer periphery of the rotor 120 across the effective space of the chamber 112. As described above, the effective space may have a volume and a cross-section that change along in a circumferential direction of the cylinder 110. Therefore, compression spaces of different volumes may be formed between the vanes 140 that divide the effective space in a radial direction, as shown in the drawing. Each compression space between the vanes 140 may be changed continuously while the vanes 140 rotate with the rotor 120, that is, while the vanes 140 move in the circumferential direction of the cylinder 110. That is, the vanes 140 may divide the chamber 112 in the cylinder 110, that is, the effective space, to define a plurality of compression spaces that are variable during rotation of the rotor 120 or the vane 140, that is, continuously variable during rotation. Each of these variable compression spaces may independently suction, compress, and discharge the working fluid using a changed volume of the compression space, and a series of operations will be described with reference to the related drawings.

These compression spaces need to be properly sealed in order to compress the working fluid at a high pressure. Therefore, for proper sealing, the vanes 140 need to reach the outer periphery of the chamber 112 from the rotor 120, that is, an inner periphery (or inner circumferential surface) of the body 111 of the cylinder 110. As described above, as the rotor 120 is relatively eccentric to the chamber 112, as shown in FIG. 3, a distance between one point of the rotor 120 and the inner periphery of the cylinder 110 that is, an outer periphery of the chamber 112, may be continuously changed during rotation of the rotor 120. Thus, the vanes 140 disposed at such one point of the rotor 120 may protrude from the rotor 120 by different distances in response to a change in the distance between the point of the rotor 120 and the inner periphery of the cylinder 110, which is changed to reach the inner periphery of the cylinder 110.

To enable such movement of the vanes 140 during rotation of the rotor 120, the rotor 120 may include slots 122 corresponding to the vanes 140: 140*a* to act as a guide mechanism 140*c*. As shown in FIGS. 2 and 3, the slot 122 may extend a predetermined length radially inward from the outer periphery of the body 121 of the rotor 120 and may accommodate the vane 130 therein. Accordingly, the length of the slot 122 may determine a minimum protrusion length of the vanes 140. As described above, due to relative eccentricity to the chamber 112 of the rotor 120, the outer periphery of the rotor 120 may be partially adjacent to the outer periphery of the chamber 112, that is, the inner periphery of the body 111 of the cylinder 110, and thus when the vanes 140 protrude largely, the vanes 140 may interfere with the cylinder 110. Accordingly, the length of the slot 122, actually a radial length, may prevent such interference, and for example, may be set to be substantially equal to the length of the vanes 140.

In addition, if the vanes 140 are not accurately oriented and placed in an accurate position as designed, working fluid may leak between the inner periphery of the cylinder 110 and an end of the vanes 140 facing the same. That is, when the vanes 140 are not accurately oriented in a radial direction of the rotor 120, that is, in a radial direction of the cylinder 110 and are tilted at a predetermined angle with respect to the radial direction, the end of the vanes 140 may also be tilted with respect to the inner periphery of the cylinder 110, and a large gap may be formed between the titled end of the vane 140 and the inner periphery of the cylinder 110, and leakage may occur. For this reason, the slot 122 may be oriented towards the center O of the cylinder 110. That is, the slot 122 may extend in the radial direction of the cylinder 110, and a longitudinal center line of the slot 122 may pass through the center O of the cylinder 110. In addition, both side portions 122 and 122*b* of the slot 122 may be in close contact with side surfaces of the vanes 140 to prevent a gap from being formed. Accordingly, by the slot 122, the vanes 140 may be accurately oriented toward the center O of the cylinder 140 in the radial direction of the cylinder 140 and may move in the radial direction. The slot 122 may move in the radial direction of the cylinder 110 and may accurately guide the vanes 140 to protrude from the rotor 120 to the inner periphery of the cylinder 110.

During rotation of the rotor 120, in order for the vanes 140 to reach the inner periphery of the cylinder 110, an appropriate drive force needs to be applied to the vanes 140 to move the vanes 140 to correspond to a change in distance between the rotor 120 and the cylinder 110. In order to apply such a drive force, the compression part 100 may include a guide groove 150 as an additional guide mechanism. As shown in FIGS. 2 to 4, the guide groove 150 may receive a portion of each of the vanes 140 to basically guide movement of the vanes 140. The guide groove 150 may be formed on a surface of the bearing 130 facing the cylinder 110 or the chamber 112 not to interfere with other components of the compression part 100 and compression inside of the chamber 112 while receiving a portion of the vanes 140. In order to stably guide the movement of the vanes 140, the guide groove 150 may include first and second guide grooves 150*a* and 150*b* respectively formed in the first and second bearings 130*a* and 130*b*, and thus, may accommodate portions disposed above and below the vanes 140, respectively. The guide groove 150 may continuously extend throughout a circumferential direction while having a ring shape, that is, having a predetermined radius, and thus, may actually guide the entire rotational motion of the vanes 140 according to rotation of the rotor 120.

As shown in FIG. 3, the guide groove 150 may be disposed to be eccentric to the rotor 120 but may be concentric with the chamber 112, that is, to share the same center C of the chamber 112. That is, the guide groove 150 may maintain a constant radial distance with respect to the outer periphery of the chamber 112, that is, the inner periphery of the cylinder 110, and this distance may be generally set equal to a radial length of the vanes 140. With this configuration, as shown in FIG. 3, the vanes 140 may be constrained by the guide groove 150 while the rotor 120 rotates and may continue to rotate while reaching the inner periphery of the cylinder 110 along the guide groove 150. That is, the guide groove 150 may apply a force to the vanes 140 to move relative to the rotor 120 eccentrically to the chamber 112 by constraining the vanes 140. Therefore, the vanes 140 may reciprocate in the radial direction while being guided by the slot 122 from the eccentric rotor 120 and may maintain a state in which the vanes 140 reach the inner periphery of the cylinder 110 due to the relative reciprocating motion. For this reason, the guide groove 150 may continuously guide the vanes 140 to protrude from the rotor 120 to the inner periphery of the cylinder 110 while the rotor 120 rotates, and thus, a plurality of sealed compression spaces may be defined inside of the chamber 112.

As described above, the guide groove 150 is formed concentrically with the chamber 112 to maintain a fixed distance between the outer periphery of the guide groove 150 and the outer periphery of the chamber 112, and thus, a distance between the end of the vanes 140 constrained to the guide groove 150 and the inner periphery of the cylinder 110 may also be adjusted by adjusting the fixed distance. Therefore, the ends of the vanes 140 may not reach the inner periphery of the cylinder 110 but may not be in direct contact with the inner periphery of the cylinder 110 by adjusting the distance between the guide groove 150 and the outer periphery of the chamber 112. As only a very fine gap may be formed up to the inner periphery of the cylinder 110 by the end of the vanes 140, vibration and noise generated by contact with the inner periphery of the cylinder 110 may be largely reduced without actually causing leakage of the working fluid.

Referring to FIG. 5, the vanes 140 may also have an advantageous structure to be guided by the guide mechanism as described above, that is, the slot 122 and the guide groove 150 to perform effective compression. First, to be advantageously guided by the slot 122 of the rotor 120, each of the vanes 140 may include a radially elongated body 141. As shown in the drawing, the body 141 may have a rectangular prism shape with a thin thickness, but may have any other shape if necessary. The body 141 may include a first end portion 141*a* disposed in the rotor 120 not to be separated from the rotor 120, and a second end portion 141*b* that protrudes from the rotor 120 and adjacent to the inner periphery of the cylinder 110.

The vanes 140 may include a pin 142 that extends vertically from the first end portion 141*a* of the body 141 toward the adjacent guide groove 150. The pin 142 may be inserted into the guide groove 150 in order to guide rotation of the vanes 140. That is, the pin 142 may include first and second pins 142*a* and 142*b* that are inserted into the first and second guide grooves 150*a* and 150*b*, respectively. To be inserted into the first and second guide grooves 150*a* and 150*b*, respectively, the first pin 142*a* may extend downward from a bottom surface of the body 141 by a predetermined length, and the second pin 142*b* may extend upward from a top surface of the body 141 by a predetermined length. In addition, as shown in FIG. 3, the slot 122 may include a seat 122*c* that is formed at an inner end of the rotor 120 thereof, that is, the closed end, and stably receives the pins 142: 142*a* and 142*b*. As the pin 142 moves along the guide groove 150 during rotation of the rotor 120, the vanes 140 may rotate stably without being separated from the guide groove 150. The pins 142: 142*a* and 142*b* may be integrally formed with the body 141, and high structural strength may be ensured. The pins 142: 142*a* and 142*b* may be detachably coupled to the body 141, and may be replaced with other pins when the pins 142: 142*a* and 142*b* wear out and break.

The compression part 100 may effectively and efficiently perform compression of the working fluid in a stable and reliable manner by collaboration of parts thereof, and this compression operation will be detailed below step by step with reference to FIG. 6.

First, referring to FIG. 6(*a*), first to third vanes 140*a*, 140*b*, and 140*c* may divide the chamber 112, accurately, an effective space thereof into a plurality of compression spaces. That is, a first compression space 112*a* may be formed between the first and second vanes 140*a* and 140*b*, a second compression space 112*b* may be formed between the second and third vanes 140*b* and 140*c*, and a third compression space 112*c* may be formed between the third and first vanes 140*c* and 140*a*. The compression spaces 112*a*, 112*b*, and 112*c* may have different sizes due to the rotor 120 eccentric relative to the chamber 112. Among the vanes 140, the first vane 140*a* may be disposed at a point S closest to the inner periphery of the cylinder 110, and the first compression space 112*a* may currently communicate with the suction port 113 to suction the working fluid. Hereinafter, for clarity and concise explanation, a compression operation of the compression part 100 will be described in relation to the first vane 140*a* and the first compression space 112*a*.

In the state of FIG. 6(*a*), when the first vane 140*a* starts to rotate clockwise, the first compression space 112*a* may gradually expand and continuously suction more working fluid through the suction port 113. As shown in FIG. 6(*b*), when the first vane 140*a* starts to rotate 90° from the starting point (S), the first compression space 112*a* may expand largely to suction sufficient working fluid, and the first vane 140*a* may pass the suction port 113 to isolate the suction port 113 from the first compression space 112*a*. In the state of FIG. 6(*b*), when the first vane 140*a* continues to rotate clockwise through 180° to 270°, the first compression space 112*a* may compress the working fluid therein while being gradually reduced again, as shown in FIGS. 6(*c*) and 6(*d*). In the state of FIG. 6(*d*), the first compression space 112*a* may communicate with the discharge port 114 to start discharging the compressed working fluid to the outside. In the state of FIG. 6(*d*), when the first vane 140*a* rotates more clockwise, the first compression space 112*a* may continuously discharge more compressed working fluid through the discharge port 114 while being gradually reduced, and as shown in FIG. 6(*a*), when the first vane 140*a* rotates up to 360°, one cycle of suction-compression-discharge ends. After the end of this cycle, the same cycle may be repeated by continuous rotation of the rotor 120. In addition, these same cycles may be simultaneously performed in the second and third compression spaces 112*b* and 112*c*, and may be repeated as well.

As described above, the guide mechanism of the vanes 140 may include only the slot 122 and the guide groove 150, and thus, may be formed by simple mechanical processing and may not increase the number of parts. Therefore, the guide mechanism may have a simple structure, and may be easily provided in the compressor 1 by a simple process. The guide mechanism may accurately orient and move the vane 100 in a radial direction of the cylinder 110 during an operation of the compression part 100. For this reason, the guide mechanism may achieve reliability and stability of operation while increasing productivity of the compressor 1. Nevertheless, improvement of the reliability and stability of the compressor 1 and the compression part 100 in various aspects may be additionally considered. For example, the bearing 130 may be completely stationary, while the vanes 140 may move at high speed along the guide groove 150 formed in the bearing 130 together with the rotor 120. Accordingly, the vanes 140 and the pin 142 thereof may have a relatively large relative speed with respect to the bearing 130 and the guide groove 150, and accordingly, friction and abrasion generated in the pin 142 may be increased. For this reason, the compression part 100 may further include an auxiliary bearing 200 rotating together with the vanes 140 to support rotation of the vanes 140.

Figure 7:
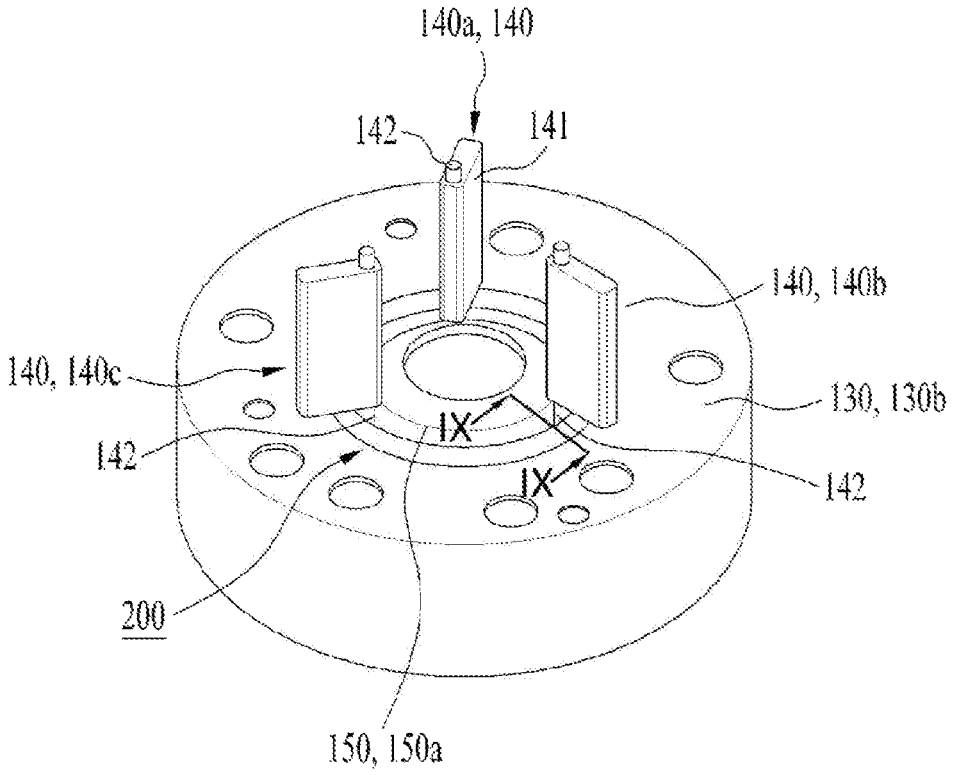
FIG. 7 is a perspective view of an assembly of a lower bearing and vane of a compression part including an auxiliary bearing according to an embodiment.
Figure 8:
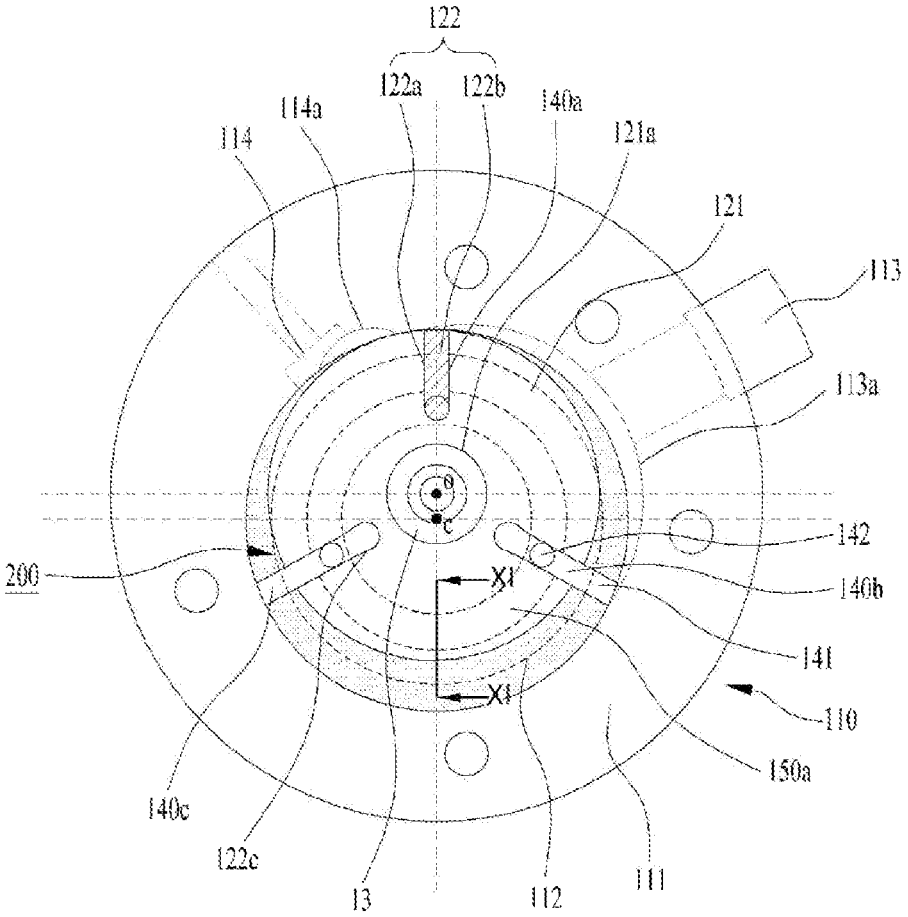
FIG. 8 is a plan view of a compression part including an auxiliary bearing.
Figure 9:
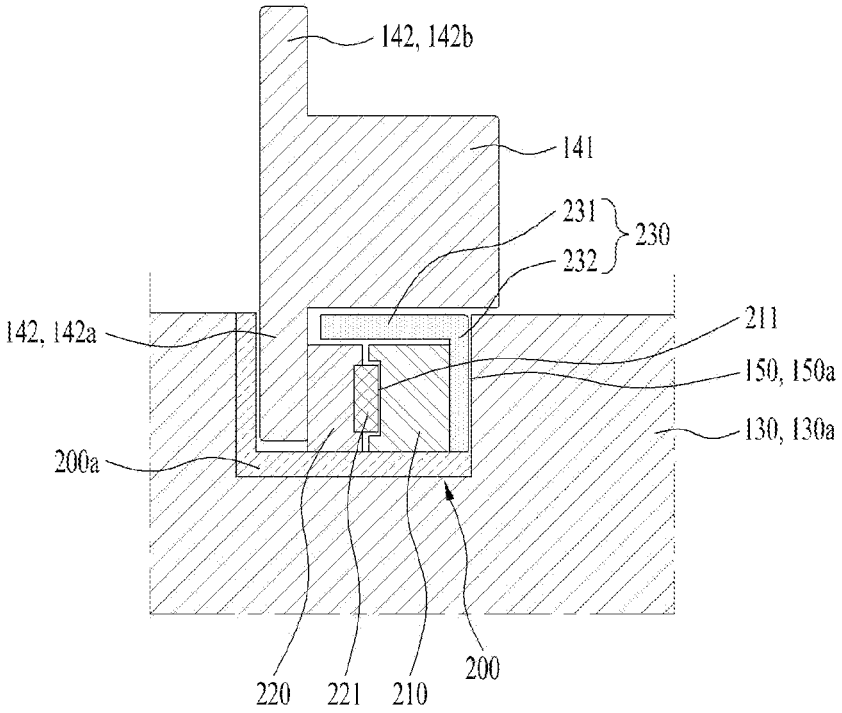
FIG. 9 is a cross-sectional view of an auxiliary bearing, taken along line IX-IX of FIG. 7 according to an embodiment.
Figure 10:
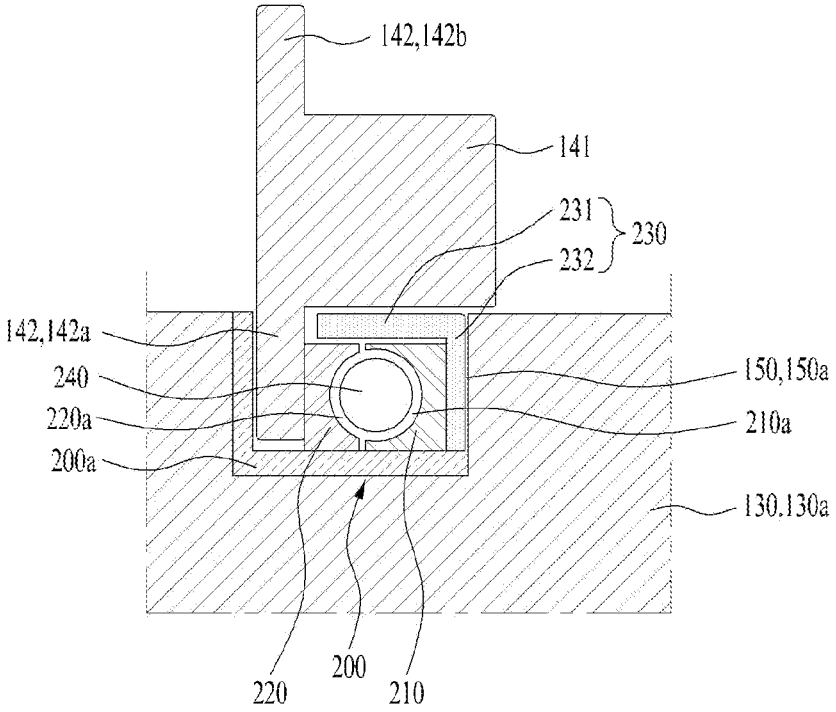
FIG. 10 is a cross-sectional view of an auxiliary bearing, taken along line IX-IX of FIG. 7 according to another embodiment.
Figure 11:
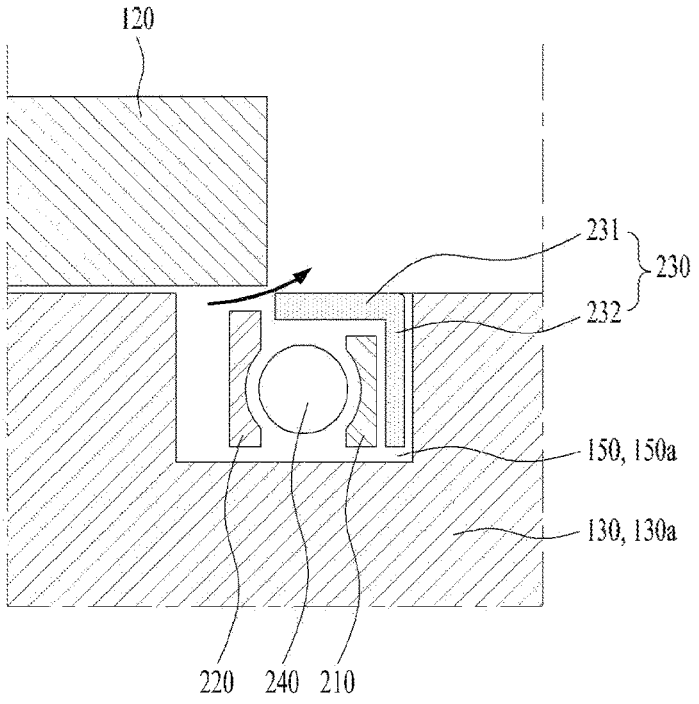
FIG. 11 is a set of cross-sectional views, taken along line XI-XI of FIG. 8.
Figure 11:
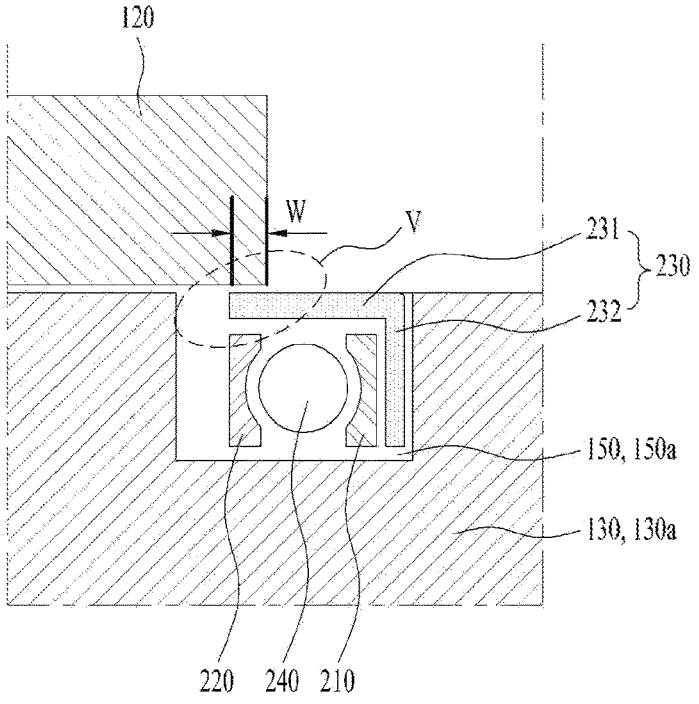
Figure 12:
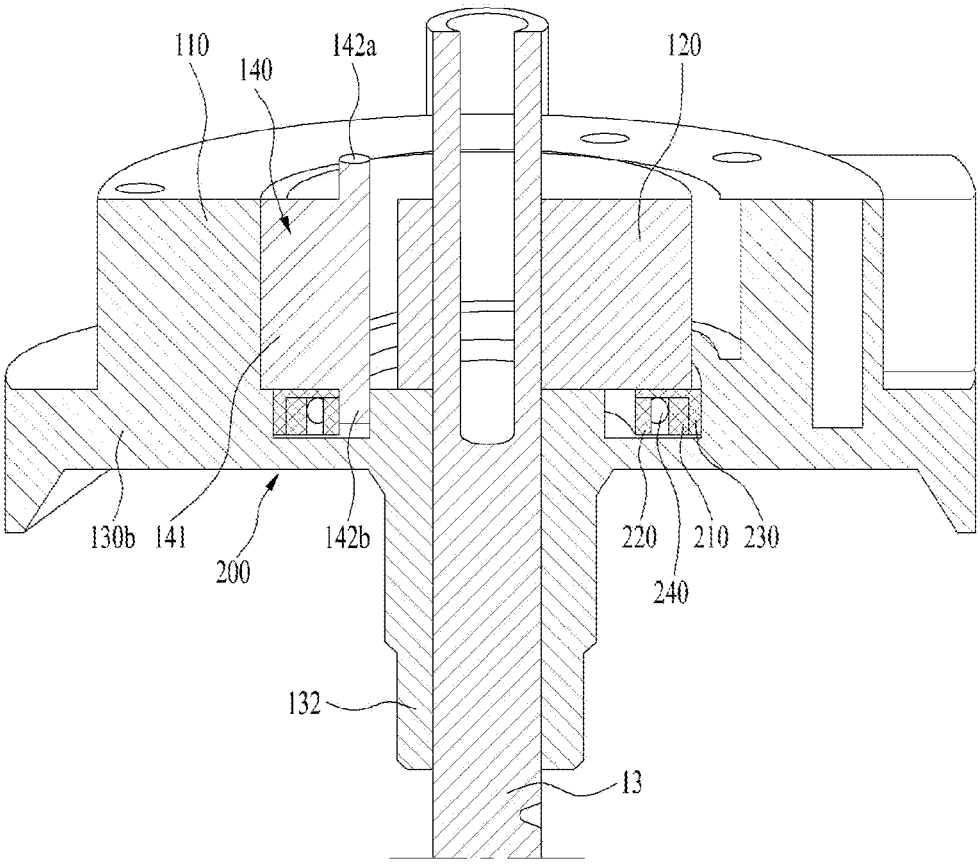
FIG. 12 is a cross-sectional view of a compression part including an auxiliary bearing applied to an upper bearing.

FIG. 7 is a perspective view of an assembly of a lower bearing and vane of a compression part including an auxiliary bearing according to an embodiment. FIG. 8 is a plan view showing a compression part including an auxiliary bearing. FIGS. 9 and 10 are a set of cross-sectional views of auxiliary bearings, taken along line IX-IX of FIG. 7 according to an embodiment and another embodiment. FIG. 11 is a set of cross-sectional views, taken along line XI-XI of FIG. 8. FIG. 12 is a cross-sectional view of a compression part including an auxiliary bearing applied to an upper bearing. With reference to these drawings, the auxiliary bearing 200 will be described hereinafter.

As the guide groove 150 is disposed adjacent to the vanes 140, the auxiliary bearing 200 may be provided in any one of the first and second guide grooves 150*a* and 150*b* to be easily connected to the vanes 140. Even if the auxiliary bearing 200 is provided in any one of the first and second guide grooves 150*a* and 150*b*, the auxiliary bearing 200 may rotate with the vanes 140 while supporting the vanes 140 with respect to the bearing 130 which is stationary. That is, the auxiliary bearing 200 may be interposed between the bearing 130 (including the guide grooves 150) and the vanes 140 to rotate together with the vanes 140, and may contact the bearing 130 which is stationary instead of the vanes 140 to support the vanes 140. Thus, the auxiliary bearing 200 may significantly reduce the relative speed of the vanes 140 with respect to the bearing 130 which is stationary and the guide grooves 150. Accordingly, in the following description, the auxiliary bearing 200 will be described with reference to the examples of FIGS. 7 to 11 applied to the first guide groove 150*a*. However, as shown in FIG. 12, the auxiliary bearing 200 may be disposed on the second guide grooves 150*b* of the second bearing 130*b*, or may be disposed in both the first and second guide grooves 150*a* and 150*b*. The auxiliary bearing 200 disposed on the second bearing 130*b* may be the same as the auxiliary bearing 200 disposed on the first bearing 130*a* of FIGS. 7-11, and accordingly, description thereof will be replaced with the description of the auxiliary bearing 200 placed on the first bearing 130*a*, given with reference to FIGS. 7 to 11, and additional description has been omitted.

Referring to FIGS. 9 and 10 along with FIGS. 7 and 8, the auxiliary bearing 200 may include an outer ring 210 disposed in the first guide groove 150*a*. The outer ring 210 may be immovably fixed in the first guide groove 150*a* to rotatably support the inner ring 220 and the vanes 140 (more precisely, a part or portion thereof), which will be described hereinafter. The outer ring 210 may be disposed adjacent to a sidewall of the first guide groove 150*a* to allow a space within the first guide groove 150*a* to receive portions of the inner ring 220 and the vanes 140. For example, as shown in the drawings, the outer ring 210 may be disposed adjacent to a radially outer wall of the first guide groove 150*a*, that is, an outer periphery thereof or may be disposed adjacent to a radially inner wall of the first guide groove 150*a*. The outer ring 210 may have a continuous ring-shaped body in order to stably support the entire rotation of the vanes 140 and the inner ring 210. That is, the outer ring 210 may continuously extend in a circumferential direction along the first bearing 130*a* or the first guide groove 150*a*.

The auxiliary bearing 200 may also include the inner ring 220 placed in the first guide groove 150*a* together with the outer ring 210. The inner ring 220 may be rotatable relative to the fixed outer ring 210 to enable rotational movement of the vanes 140. The inner ring 220 may be rotatably disposed between the outer ring 210 and a part or portion of the vanes 140 disposed within the first guide groove 150*a*, that is, the pin 142*a*. As described above, when the outer ring 210 is disposed adjacent to either sidewall of the first guide groove 150*a*, a part or portion of the vanes 140, that is, the pin 142*a* may be disposed adjacent to another sidewall of the opposite first guide groove 150*a*, and the inner ring 220 may be disposed between the outer ring 210 and the pin 142*a*. For example, as shown in the drawing, when the outer ring 210 is disposed adjacent to a radially outer wall of the first guide groove 150*a*, that is, an outer periphery thereof, the pin 142*a* may be disposed adjacent to a radially inner wall of the first guide groove 150*a*, that is, an inner periphery thereof, and the inner ring 220 may be disposed between the outer ring 210 and the pin 142*a*. Even when the outer ring 210 and the pin 142*a* are disposed opposite to those illustrated in the drawing, the inner ring 220 may be disposed between the outer ring 210 and the pin 142*a*. In the following, for brevity of explanation, in relation to the outer ring 210 adjacent to the outer periphery of the first guide groove 150*a*, the pin 142*a* adjacent to the inner periphery of the first guide groove 150*a*, and the inner ring 220 between them, features of the auxiliary bearing 200 are described, but these features may be equally applied to the auxiliary bearing 200 having an opposite arrangement, that is, the outer ring 210 adjacent to the inner periphery of the first guide groove 150*a*, without significant deformation. The inner ring 220 may also extend in the circumferential direction with a limited length to support only a portion of the vanes 140, that is, the pin 142*a*. As shown in the drawing, for stable support of the vanes 140, the inner ring 220 may have a continuous ring-shaped body, and may continuously extend to face the outer ring 210 in the circumferential direction along the first bearing 130*a* or the first guide groove 150*a*.

The inner ring 220 may be in contact with a portion of the vanes 140 to rotate together with the vanes 140. The inner ring 220 may contact any part of the vanes 140 that allow simultaneous rotation, for example, a part of the vanes 140 adjacent the first guide groove 150*a*, that is, a lower part thereof. The inner ring 220 may be in contact with the pin 142*a* which is part of the vanes 140 inserted into the first guide groove 150*a* for stable contact. In this case, in order to ensure a wide contact surface, an outer surface of the inner ring 220 (in the drawing, inner circumferential surface) is in contact with the outer surface of the pin 142*a*, while an outer circumferential surface of the inner ring 220 may face the inner circumferential surface of the outer ring 210. The inner ring 220 may be in contact with the pin 142*a* but may not be fixed with the pin 142*a*. Even in this case, partial slip occurs and the inner ring 220 may rotate relative to the pin 142*a* (that is, the vanes 140), but the inner ring 220 may rotate with the vanes 140 due to contact resistance between the inner ring 220 and the pin 142*a*. Accordingly, the relative speed of the vanes 140 with respect to the bearing 130 may be effectively reduced. The pin 142*a* may be immovably coupled or fixed to the inner ring 220. In this case, the inner ring 220 may rotate at the same speed simultaneously with the pin 142*a* and the vanes 140 without any relative motion, and may completely remove the relative speed of the vanes 140 with respect to the bearing 130.

As shown in FIG. 9, the inner ring 220 may be in direct contact with the outer ring 210 to be rotatably fixed to the bearing 130 and relatively rotatable to the outer ring 210 which is stationary. The outer periphery of the inner ring 220 may be in direct contact with the inner periphery of the outer ring 210, and the inner ring 220 may be rotatably guided and supported with respect to the outer ring 210 by the outer periphery of the inner ring 220. Resistance and abrasion may occur in the outer periphery of the inner ring 220 due to friction with the outer ring 210. Accordingly, the inner ring 220 may include a lubricating member 221 provided to the outer periphery. The lubricating member 221 may be made of a material having a high strength and a low friction coefficient, and if necessary, may be applied with a predetermined lubricant. The lubricating member 221 may continuously extend in the circumferential direction to be formed over the entire outer periphery of the inner ring 220. In addition, the outer ring 210 may include a groove 211 that accommodates the lubricating member 221 in an inner periphery thereof. Accordingly, the inner ring 220 may be rotated relatively smoothly and stably by the lubricating member 221 while in contact with the outer ring 210.

As shown in FIG. 10, for relative rotation of the inner ring 220 with respect to the outer ring 210, the auxiliary bearing may further include a rolling member 240 disposed between the outer ring 210 and the inner ring 220. The inner ring 220 and the outer ring 210 may be spaced apart from each other at a predetermined distance, and the rolling member 240 may be disposed between the spaced apart the outer ring 210 to contact them. More precisely, the rolling member 240 may be in contact with each of the inner periphery of the outer ring 210 and the outer periphery of the inner ring 220, and the inner periphery of the outer ring 210 and the inner periphery of the outer ring 210 may include recesses 210*a* and 220*a* that extend lengthwise in the circumferential direction thereof in order to stably accommodate the rolling member 240. The rolling member 240 may have a shape that is easy to roll, for example, a spherical shape, as shown in the drawing, or may have a cylindrical shape. Accordingly, the rolling member 240 may allow the inner ring 220 to rotate stably and smoothly with respect to the outer ring 210 while rolling between the outer ring 210 and the inner ring 220.

Due to this installation of the auxiliary bearing 200, the first guide groove 150*a* may substantially extend, and the working fluid in the chamber 112 may leak through the auxiliary bearing 200. Accordingly, the auxiliary bearing 200 may include a cover 230 that covers a surface thereof. In order to prevent leakage of the working fluid, the cover 230 may completely cover the surface facing the chamber 112 of the auxiliary bearing 200 as a whole. The cover 230 may include a first cover 231 that is disposed on an exposed portion of the auxiliary bearing 200 disposed in the first guide groove 150*a*, that is, ends (upper parts in the drawing) opposite to a bottom portion of the first guide groove 150*a* of the outer ring 210 and the inner ring 220. The first cover 231 may extend horizontally in the radial direction from the end of the outer ring 210 to the end of the inner ring 220. In addition, when the first cover 231 extends over the entire first guide groove 150*a* in the circumferential direction of the outer ring 210 or the inner ring 220, the first cover 231 may also extend in the circumferential direction to entirely cover the outer ring 210 and the inner ring 220. The cover 230 may include a second cover 232 that extends vertically from the first cover 231. The second cover 232 may be disposed between the outer ring 210 and an inner surface of the first guide groove 150*a*, and may be coupled to the outer ring 210. Accordingly, the outer ring 210 may be stably fixed in the first guide groove 150*a*. The auxiliary bearing 200, that is, the outer ring 210 and the inner ring 220 thereof, may be surrounded by the cover 230, and thus, may be isolated from the chamber 112 to prevent leakage and may be stably supported.

For smoother rotation of the pin 142*a* and the inner ring 220, a lubricating member 200*a* may be additionally disposed in the first guide groove 150*a*. The lubricating member 200*a* may be disposed on an inner surface of the first guide groove 150*a* in contact with the pin 142*a* and the inner ring 220. For example, the lubricating member 200*a* may be disposed on the inner circumferential surface of the first guide groove 150*a* and interposed between the inner circumferential surface and the pin 142*a*. In addition, the lubricating member 200*a* may be disposed on a bottom surface of the first guide groove 150*a* and interposed between the bottom surface and the pin 142*a*/the inner ring 220. The lubricating member 200*a* may be made of a material having a high strength and a low friction coefficient, and if necessary, may be applied with a predetermined lubricant. The pin 142*a* and the inner ring 220 may be rotated relatively smoothly and stably by the lubricating member 221 while in contact with the lubricating member 200*a*.

As described above, the auxiliary bearing 200 may enable the vanes 140 to rotate smoothly while in contact with the bearing 130 which is stationary instead of the vanes 140 to support the vanes 140. Therefore, the auxiliary bearing 200 may significantly reduce the relative speed of the vanes 140 with respect to the bearing 140 which is stationary and the guide grooves 150, and accordingly, wear and breakage due to friction of the vanes 140, more precisely, the pin 142 thereof may also be significantly reduced. For this reason, the auxiliary bearing 200 may largely increase the structural stability and reliability of the vanes 140, and accordingly, the stability and reliability of the compressor 1 itself may also be increased.

The rotor 120 may rotate in the chamber 112 at high speed, and thus, when the auxiliary bearing 200 protrudes into the chamber 112, the auxiliary bearing 200 may interfere with the rotor 120 and be damaged. Accordingly, as shown in FIGS. 9 and 10 as well as in FIG. 11, the auxiliary bearing 200, that is, all parts 210 to 240 thereof, may be accommodated without protruding from the first guide groove 150*a*. In addition, as shown in FIG. 8, the rotor 120 is arranged eccentrically relative to the first guide groove 150*a*, and thus, a part of the rotor 120, in particular, an outer periphery thereof, may be disposed not to overlap the bearing 200, that is, not to at least partially cover the auxiliary bearing 200 as shown in FIG. 11(*a*). However, in this case, a gap may be formed between the outer periphery of the rotor 120 and the auxiliary bearing 200, and working fluid may leak through the gap. That is, the compression spaces may not be completely sealed and may communicate with each other through such a gap, and compression efficiency may be reduced. For this reason, in order to prevent leakage of the working fluid, the auxiliary bearing 200 may be arranged to at least partially overlap the rotor 120 as indicated by a region V in FIG. 11(*b*). In order to ensure a more secure sealing, a radial length or width W of such an overlap region V may be practically set to at least 1.5 mm.

The above exemplary embodiments are therefore to be construed in all aspects as illustrative and not restrictive. The scope should be determined by the appended claims and their legal equivalents, not by the above description, and all changes coming within the meaning and equivalency range of the appended claims are intended to be embraced therein.

The invention claimed is:

1. A rotary compressor, comprising:

a cylinder;

a chamber eccentrically formed in the cylinder and accommodating a predetermined working fluid;

a rotor rotatably disposed in the chamber and disposed concentrically to the cylinder;

first and second bearings that are disposed above and below the cylinder to seal the chamber, respectively and support a drive shaft of the rotor;

a plurality of vanes movably installed in the rotor in a radial direction of the rotor and protruding to an inner circumferential surface of the cylinder from the rotor to divide the chamber into a plurality of compressed spaces;

first and second guide grooves formed concentrically to the chamber on surfaces of the first and second bearings facing the chamber, to accommodate portions of the plurality of vanes and continuously guiding the plurality of vanes to protrude to the inner circumferential surface of the cylinder while the rotor rotates; and an auxiliary bearing provided in at least one of the first guide groove or the second guide groove and rotating with the plurality of vanes, wherein the auxiliary bearing further includes a cover that isolates the auxiliary bearing from the chamber.

2. The rotary compressor of claim 1, wherein the auxiliary bearing includes:

an outer ring fixed in the at least one of the first guide groove or the second guide groove; and an inner ring in contact with the portions of the plurality of vanes and rotating relative to the outer ring with the portions of the plurality of vanes.

3. The rotary compressor of claim 2, wherein the auxiliary bearing further includes a rolling member disposed between the outer ring and the inner ring.

4. The rotary compressor of claim 1, wherein the cover entirely covers a surface of the auxiliary bearing facing the chamber.

5. The rotary compressor of claim 1, wherein the auxiliary bearing is accommodated in the at least one of the first guide groove or the second guide groove so as not to protrude from the at least one of the first guide groove or the second guide groove.

6. The rotary compressor of claim 1, wherein the auxiliary bearing is disposed to overlap the rotor in an axial direction.

7. The rotary compressor of claim 6, wherein a width of an overlap region of the auxiliary bearing and the rotor is set to at least 1.5 mm.

8. The rotary compressor of claim 2, wherein each of the plurality of vanes includes:

a body including a first end portion elongated in a radial direction of the rotor and disposed in the rotor, and a second end portion adjacent to an inner circumferential surface of the cylinder; and a pin that extends from the first end portion of the body and inserted into the at least one of the first guide groove or the second guide groove to contact the auxiliary bearing.

9. The rotary compressor of claim 8, wherein the pin contacts the inner ring of the auxiliary bearing.

10. The rotary compressor of claim 8, wherein the pin is fixed to the inner ring of the auxiliary bearing.

11. The rotary compressor of claim 8, wherein the pin is integrally formed with the body or detachably installed on the body.

12. The rotary compressor of claim 8, wherein a lubricating member having a low friction coefficient is disposed in the first and second guide grooves.

13. A rotary compressor, comprising:

a cylinder;

a chamber eccentrically formed in the cylinder and accommodating a predetermined working fluid;

a rotor rotatably disposed in the chamber and disposed concentrically to the cylinder;

first and second bearings that are disposed above and below the cylinder to seal the chamber, respectively and support a drive shaft of the rotor;

a plurality of vanes movably installed in the rotor in a radial direction of the rotor and protruding to an inner circumferential surface of the cylinder from the rotor to divide the chamber into a plurality of compressed spaces;

first and second guide grooves formed concentrically to the chamber on surfaces of the first and second bearings facing the chamber, to accommodate portions of the plurality of vanes and continuously guiding the plurality of vanes to protrude to the inner circumferential surface of the cylinder while the rotor rotates; and an auxiliary bearing provided in each of the first guide groove and the second guide groove and rotating with the plurality of vanes, wherein the auxiliary bearing includes:

an outer ring fixed in the respective first guide groove or second guide groove; and an inner ring in contact with the portions of the plurality of vanes and rotating relative to the outer ring with the portions of the plurality of vanes, wherein the auxiliary bearing further includes a cover that isolates the auxiliary bearing from the chamber.

14. The rotary compressor of claim 13, wherein the auxiliary bearing further includes a rolling member disposed between the outer ring and the inner ring.

15. The rotary compressor of claim 13, wherein the cover entirely covers a surface of the auxiliary bearing facing the chamber.

16. The rotary compressor of claim 13, wherein the auxiliary bearing is accommodated in the respective first guide groove or second guide groove so as not to protrude from the respective first guide groove or second guide groove.

17. The rotary compressor of claim 13, wherein the auxiliary bearing is disposed to overlap the rotor in an axial direction.

18. The rotary compressor of claim 13, wherein each of the plurality of vanes includes:

a body including a first end portion elongated in a radial direction of the rotor and disposed in the rotor, and a second end portion adjacent to an inner circumferential surface of the cylinder; and a pin that extends from the first end portion of the body and inserted into the respective first guide groove or second guide groove to contact the auxiliary bearing.

19. The rotary compressor of claim 18, wherein a lubricating member having a low friction coefficient is disposed in each of the first and second guide grooves.

* * * * *